US007588226B1

(12) United States Patent
Tuli

(10) Patent No.: US 7,588,226 B1
(45) Date of Patent: Sep. 15, 2009

(54) MOUNTING OF BATTERY-OPERATED BULB

(76) Inventor: Sanjeev Tuli, 101 Moonachie Ave., Moonachie, NJ (US) 07074

( * ) Notice: Subject to any disclaimer, the term of this patent is extended or adjusted under 35 U.S.C. 154(b) by 5 days.

(21) Appl. No.: 12/148,556

(22) Filed: Apr. 21, 2008

(51) Int. Cl.
*A47H 1/10* (2006.01)

(52) U.S. Cl. ..... 248/324; 248/327; 248/346.03; 362/100; 362/191; 362/368

(58) Field of Classification Search ..... 248/323, 248/346.01, 346.03, 289.11, 324–344; 362/191, 362/145, 147, 428, 100, 368
See application file for complete search history.

(56) References Cited

U.S. PATENT DOCUMENTS 4,032,707 A * 6/1977 Trenary ..... 174/562

* cited by examiner

*Primary Examiner*—John A Ward
(74) *Attorney, Agent, or Firm*—Myron Amer PC

(57) ABSTRACT

A battery-operated bulb 10 projected into a base 14 urged into a pivotal traverse 24 to be held in place to supplement ambient light at a site of use having minimal light.

1 Claim, 1 Drawing Sheet

12
10

22
26
16
24

12
3
20
16
28
20
32
10
32
18
20
10
36
14
38
34
32
28

MOUNTING OF BATTERY-OPERATED BULB

The present invention relates generally to improvements in the construction and operating mode in dwellings of battery-operated light bulbs, the improvements more particularly contributing to supplementing ambient lights in sites of use where necessary, all as will be better understood as the description proceeds.

BACKGROUND OF THE INVENTION

It is known from common experience, taking a closet as an example, that the ambient light which illuminates through an open door into the closet, is insufficient to identify hanging clothes or objects on shelves in the closet. As additional examples of ambient light shortcomings are garages and attics.

SUMMARY OF THE INVENTION

Broadly, it is the object to overcome the foregoing shortcoming of ambient light inadequacy.

More particularly, it is an object to provide a battery-operated light bulb that installs easily, in any site of use where extra light is needed for the utilitarian purposes of the user.

The description of the invention which follows, together with the accompanying drawings should not be construed as limiting the invention to the example shown and described, because those skilled in the art to which this invention appertains will be able to devise other forms thereof within the ambit of the appended claims.

BRIEF DESCRIPTION OF THE DRAWINGS

The description of the invention which follows, together with the accompanying drawing should not be construed as limiting the invention to the example shown and described, because those skilled in the art to which this invention appertains will be able to devise other forms thereof.

DETAILED DESCRIPTION OF THE INVENTION

Figures 1, 2, 3, 4:
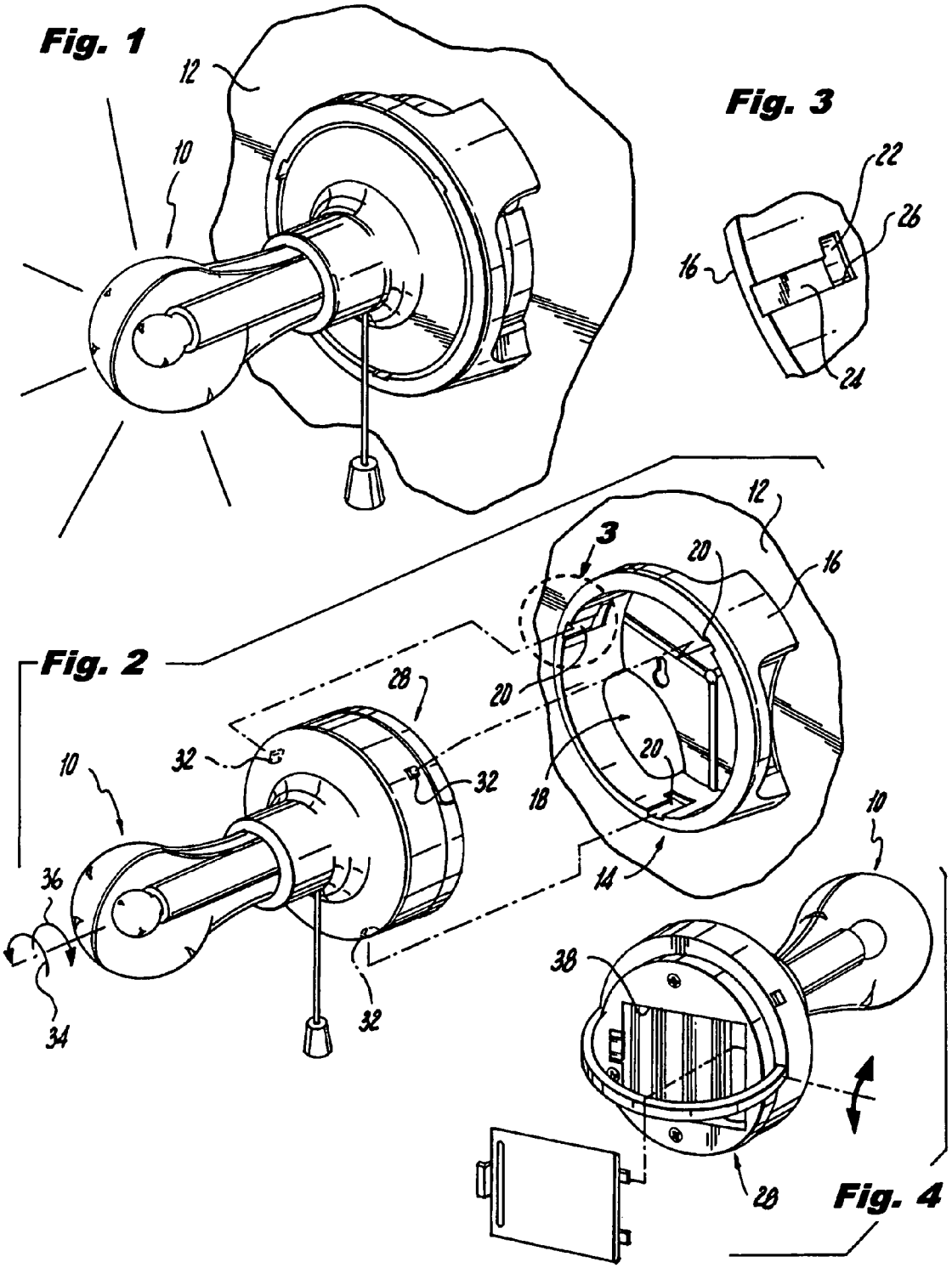
FIG. 1 is a perspective view of an assembled battery-operated light bulb according to the present invention.
FIG. 2 is an exploded view of the battery-operated light bulb of FIG. 1.
FIG. 3 is a detailed view of the structure circumscribed by arrow 3 of FIG. 2.
FIG. 4 is an assembled view similar to FIG. 1, but as seen from the rear.

In a typical end use, a battery-operated bulb generally designated 10, serves as a light source in a closet, being mounted on an end wall 12, and the battery from time to time must be replaced. To address this chore, the bulb construction includes a first outer cylindrical base 14 having a wall 16 bounding a mounting compartment 18, within which compartment there are three circumferentially spaced-apart recesses, individually and collectively designated 20.

Each recess 20 is configurated in an L-shape with a vertical leg 22 and a horizontal leg 24 subtending a ninety-degree angle 26 therebetween.

Cooperating with the outer cylindrical base 14 is a second inner cylindrical base 28 sized to fit within the mounting compartment 18 and on a wall 30 thereof having a similar matching array of three spaced-apart projections, individually and collectively designated 32, thus providing an interconnecting projection 32 for each recess 20.

Each projection 32 is provided with an operative position in projected relation within a cooperating one said recess vertical leg 22, thus causing a projection 32 to seat in the angle 26. Next, the user urges the outer base 14 in a rotational traverse, as noted by arrow 34, within the inner base 28 which locks together the bases 14 and 28.

A reverse rotational traverse 36 unlocks the bases 14 and 28, enabling the user to withdraw the inner base 28 from the outer base 14 and concomitantly providing access to a battery-compartment 38 in the inner base 28 and replacement of the batteries.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A horizontally mounted battery-operated light bulb comprising:

A. a vertical support wall;

B. a first outer cylindrical base having a wall bounding a mounting compartment;

C. three circumferentially spaced-apart recesses in said compartment mounting wall each configurated in an L-shape with (1) a vertical leg and (2) a horizontal leg subtending a ninety-degree angle therebetween;

D. a second inner cylindrical base serving as a battery housing sized to fit within said mounting compartment having a wall including three circumferentially spaced apart mounting projections extending radially therefrom in aligned relation with said three circumferentially spaced-apart recesses;

E. operative positions of said mounting projections in projected relation within a cooperating one said vertical leg;

F. a rotational traverse of a cooperating one said projection into a said horizontal leg to lock said outer and inner bases together; and G. a reverse rotational traverse of said inner base within said outer base to unlock said bases;

whereby the unlocking facilitates replacement of batteries in said battery housing.

* * * * *